US006036159A

United States Patent [19]

Yu

[11] Patent Number: 6,036,159

[45] Date of Patent: Mar. 14, 2000

[54] MUSICAL INSTRUMENT STAND

[76] Inventor: Ming-Ti Yu, 122-5, Jun Liao Road, Feng Yuan, Taichung Shien, Taiwan

[21] Appl. No.: 08/957,434

[22] Filed: Oct. 24, 1997

[51] Int. Cl.[7] ..... G10G 5/00

[52] U.S. Cl. ..... 248/443; 224/910

[58] Field of Search ..... 248/167, 443; 224/910; 84/280, 327, 329, 387 A, 453; D8/373

[56] References Cited

U.S. PATENT DOCUMENTS 5,375,497 12/1994 Pirchio et al. ..... 248/443
5,505,413 4/1996 Hennessey ..... 84/327
5,664,756 9/1997 Liao ..... 248/443
5,744,735 4/1998 Liao ..... 248/443

*Primary Examiner*—Ramon O. Ramirez
*Assistant Examiner*—Robert Lipcsik

[57] ABSTRACT

A musical instrument stand comprises an elbow rod device, an upper rod disposed on top of the elbow rod device, a hollow tube disposed on the upper rod, an upper holder inserted through the hollow tube, and two base rods disposed under the elbow rod device. The elbow rod device has a first hollow plate and a second hollow plate. A first and a second undulated brackets are disposed on the corresponding first and second hollow plates.

11 Claims, 10 Drawing Sheets

MUSICAL INSTRUMENT STAND

BACKGROUND OF THE INVENTION

The invention relates to a musical instrument stand. More particularly, the invention relates to a musical instrument stand which can be easily detached.

Referring to FIG. 10, a conventional musical instrument stand has a lower rod 12 and three legs connected by a four-way joint 13. An upper rod 11 is inserted in the lower rod 12. An upper U-shaped fork 111 extends from an upper end of the upper rod 11. A transverse pipe connects the lower rod 12. A lower U-shaped fork 121 is inserted in the transverse pipe. Since the upper rod 11 is inserted in the lower rod 12 only, the two rods 11 and 12 are not fastened tightly. The upper rod 11 may fall down after a long period of usage. Furthermore, the conventional musical instrument stand utilizes only three points to touch the ground. Thus the three legs cannot support the conventional musical instrument stand stably. The U-shaped fork 121 will occupy a large area after it is detached.

SUMMARY OF THE INVENTION

An object of the invention is to provide a guitar stand which is easily folded.

Another object of the invention is to provide a guitar stand which can lower the center of gravity of the guitar while the guitar is rested on the guitar stand.

Another object of the invention is to provide a plurality of foldable elements of a guitar stand which can be folded but cannot be detached.

Accordingly, a musical instrument stand comprises an elbow rod device, an upper rod disposed on top of the elbow rod device, a hollow tube disposed on the upper rod, an upper holder inserted through the hollow tube, and two base rods disposed under the elbow rod device. The elbow rod device has a first hollow plate and a second hollow plate. A first and a second undulated brackets are disposed on the corresponding first and second hollow plates. The elbow rod device has a joint and the first and the second hollow plates. A center through hole is formed on a top of the joint. The upper rod is inserted in the center through hole. An adjustment bolt is disposed on the joint. The first and the second hollow plates are disposed beneath the joint, respectively. The first undulated bracket has a first extending end rod, a first middle portion and a first distal end portion. The first extending end rod is inserted in an inserted hole of the first hollow plate transversely. The second undulated bracket has a second extending end rod, a second middle portion and a second distal end portion. The second extending end rod is inserted in an inserted hole of the second hollow plate transversely. A first base rod has a first strut which is inserted in a lower portion of the first hollow plate. A second base rod has a second strut which is inserted in a lower portion of the second hollow plate.

DETAILED DESCRIPTION OF THE INVENTION

Figure 1:
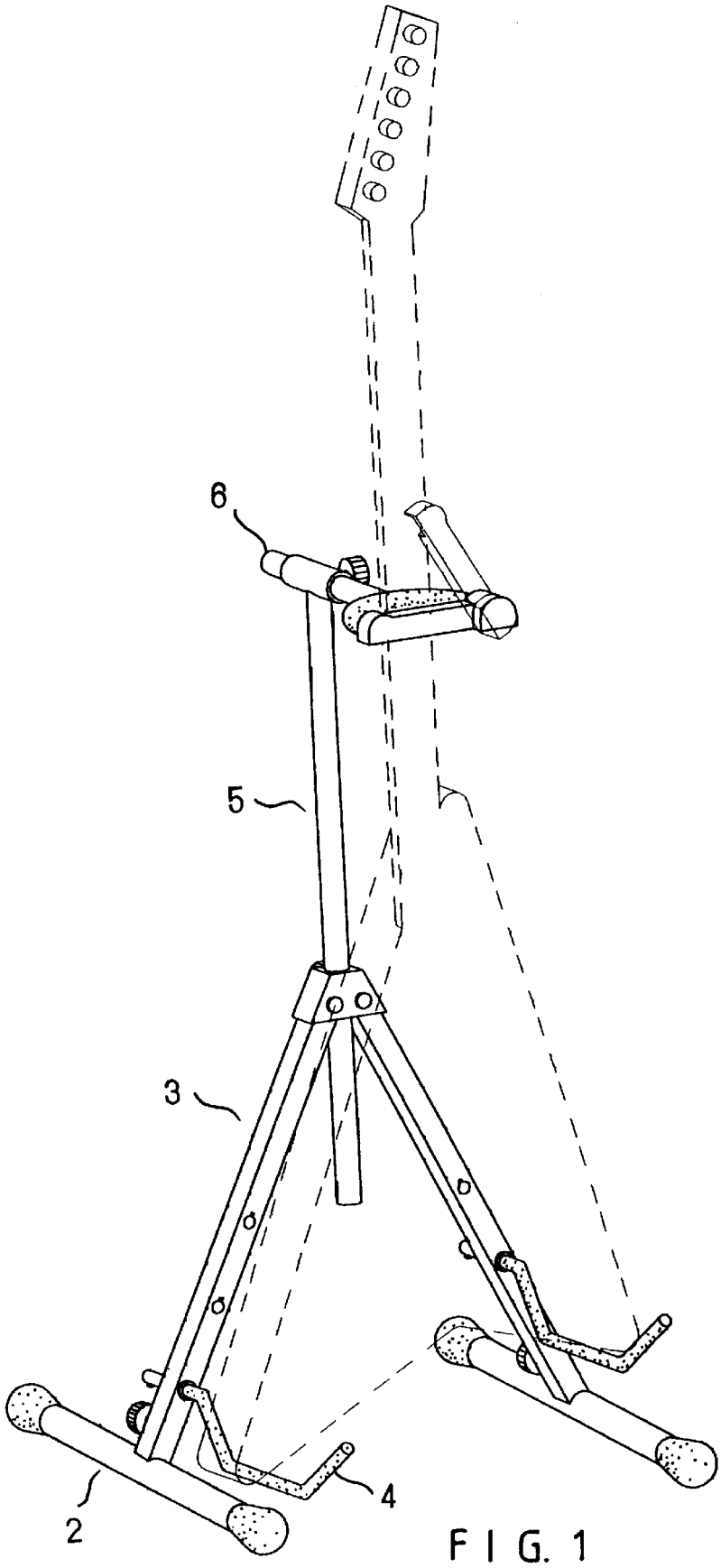
FIG. 1 is a perspective assembly view of a musical instrument stand of a preferred embodiment in accordance with the invention.
Figure 2:
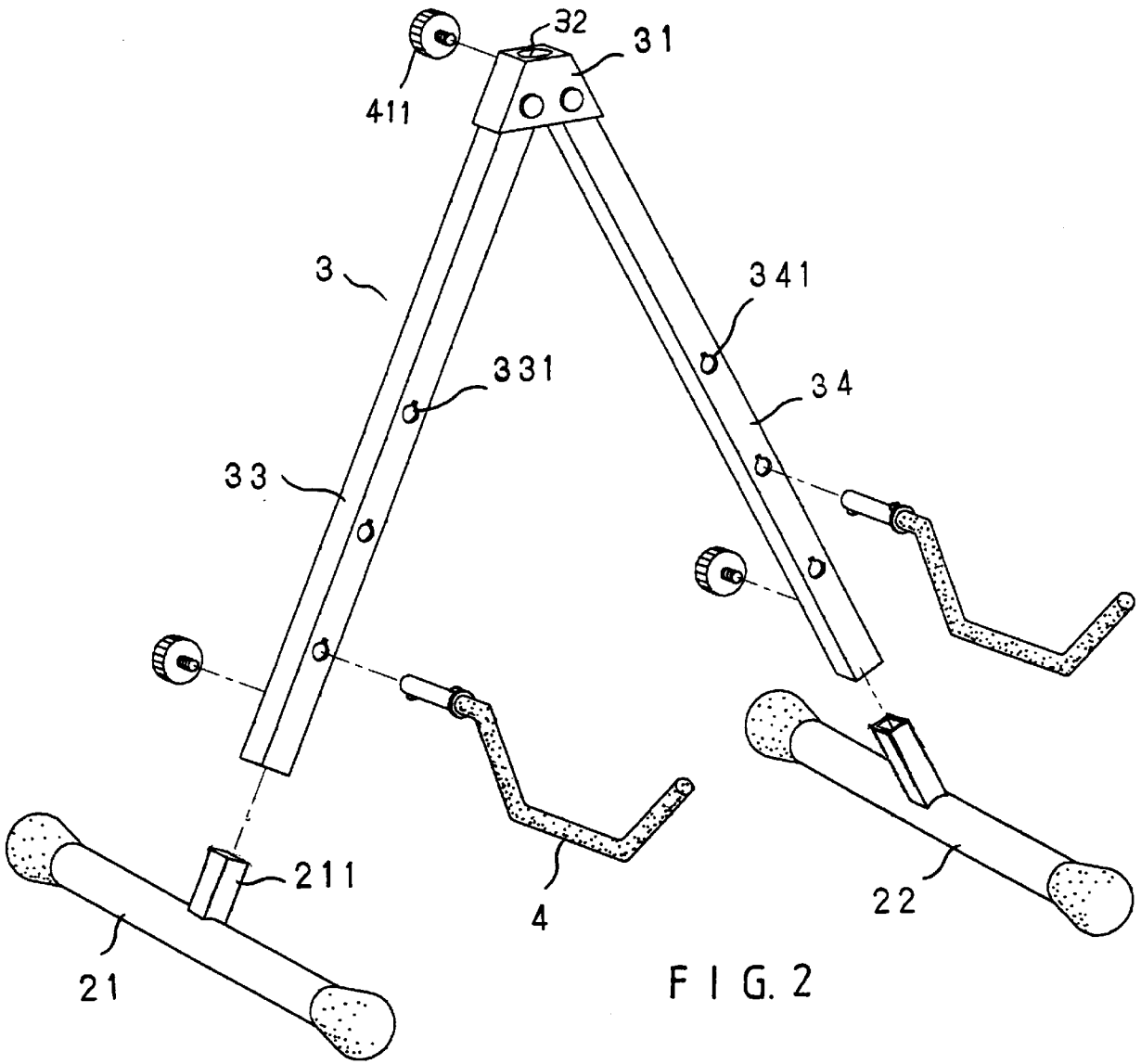
FIG. 2 is a perspective exploded view of a musical instrument stand of a preferred embodiment without an upper rod, a hollow tube and an upper holder.
Figure 3:
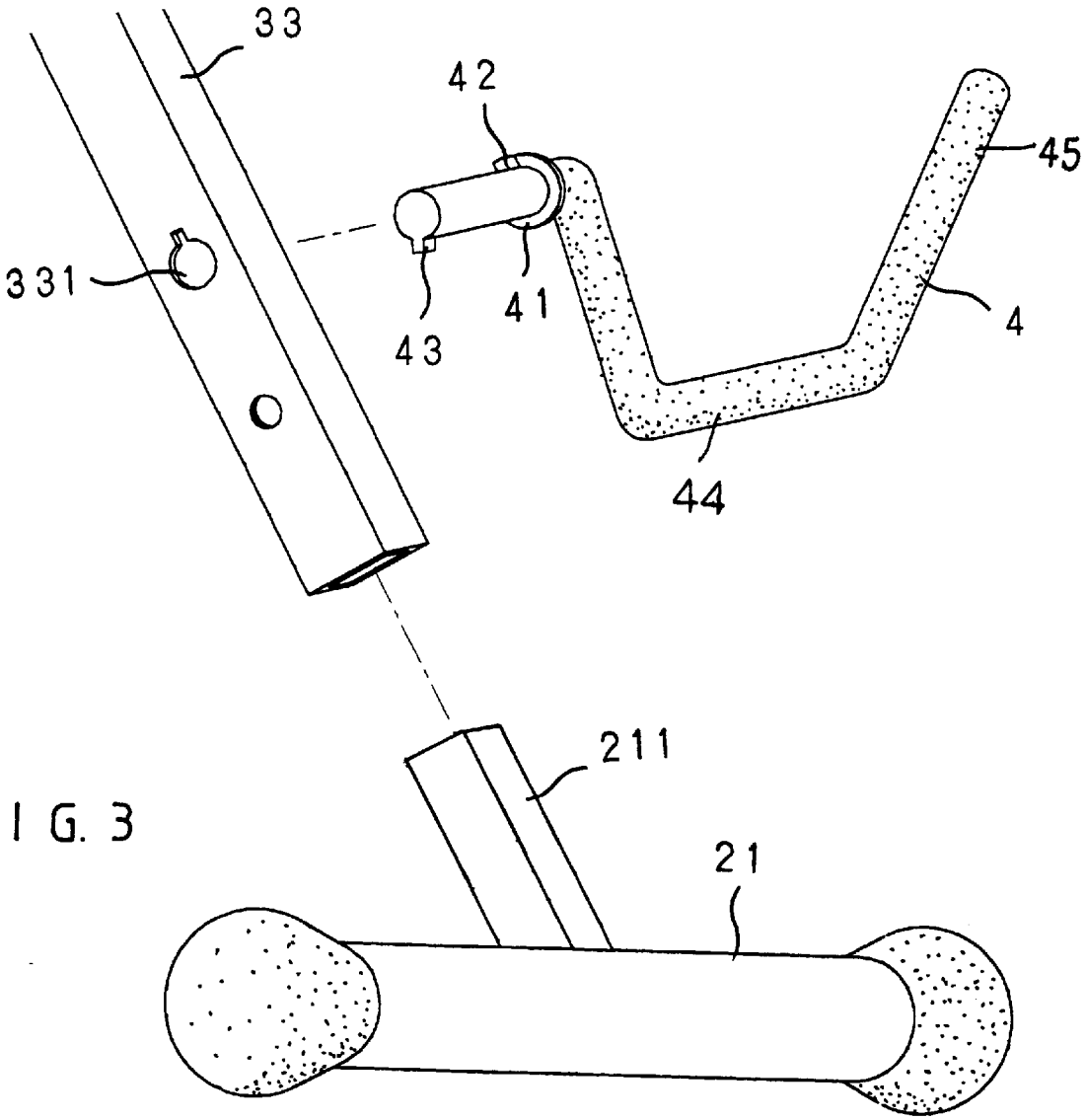
FIG. 3 is a perspective exploded view of a strut, a hollow plate and an undulated bracket.
Figure 4:
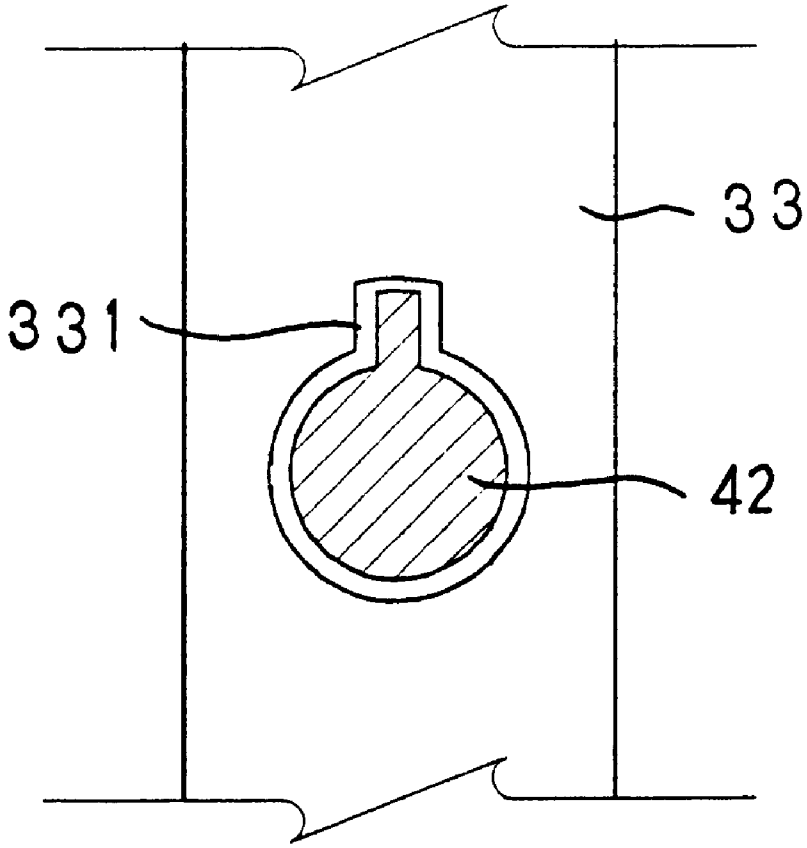
FIG. 4 is a sectional view illustrating an extending end rod inserted in a round hole.

Referring to FIGS. 1 to 4, a musical instrument stand comprises an elbow rod device 3, an upper rod 5 disposed on top of the elbow rod device 3, a hollow tube 52 disposed on the upper rod 5, an upper holder 6 inserted through the hollow tube 52, and two base rods 21 and 22 disposed under the elbow rod device 3. The elbow rod device 3 has a first hollow plate 33 and a second hollow plate 34. A first and a second undulated brackets 4 are disposed on the corresponding first and second hollow plates 33 and 34.

The elbow rod device 3 has a joint 31 and the first and second hollow plates 33 and 34. A center through hole 32 is formed on a top of the joint 31. The upper rod 5 is inserted in the center through hole 32. An adjustment bolt 411 is disposed on the joint 31 to adjust a length of the upper rod 5. The first and the second hollow plates 33 and 34 are disposed beneath the joint 31, respectively. The first hollow plate 33 has a plurality of round holes 331. The second hollow plate 34 has a plurality of circular holes 341. The first undulated bracket 4 has a first extending end rod 42, a first middle portion 44 and a first distal end portion 45. The first extending end rod 42 is inserted in one of the round holes 331 of the first hollow plate 33 transversely. The second undulated bracket 4 has a second extending end rod 42, a second middle portion 44 and a second distal end portion 45. The second extending end rod 42 is inserted in one of the circular holes 341 of the second hollow plate 34 transversely. Each of the first and the second extending end rods 42 has a blocking ring 41 and an end protrusion 43. A first base rod 21 has a first strut 211 which is inserted in a lower portion of the first hollow plate 33. A second base rod 21 has a second strut 211 which is inserted in a lower portion of the second hollow plate 33.

Figure 5:
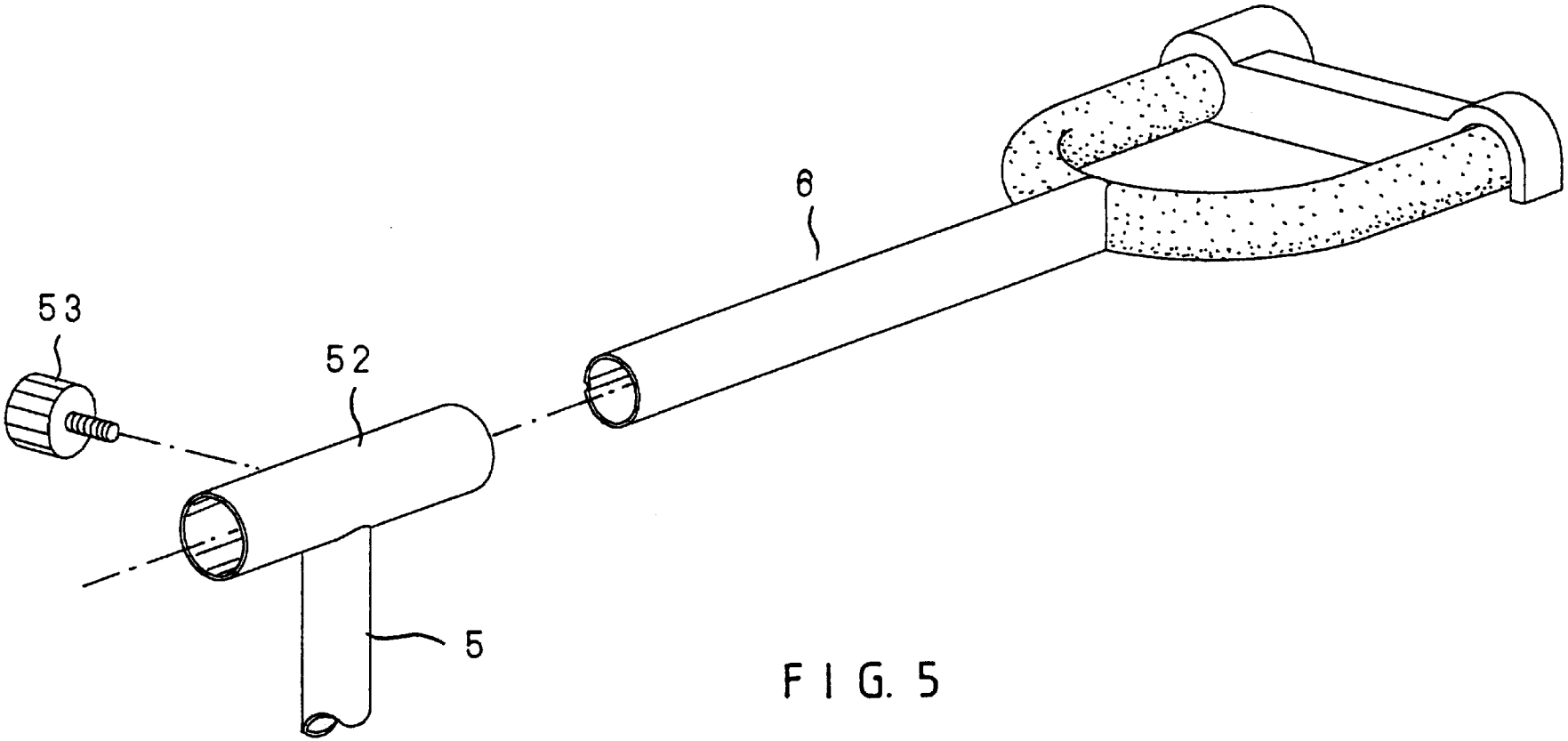
FIG. 5 is a perspective exploded view of an upper holder, a hollow tube and a positioning bolt.
Figure 6:
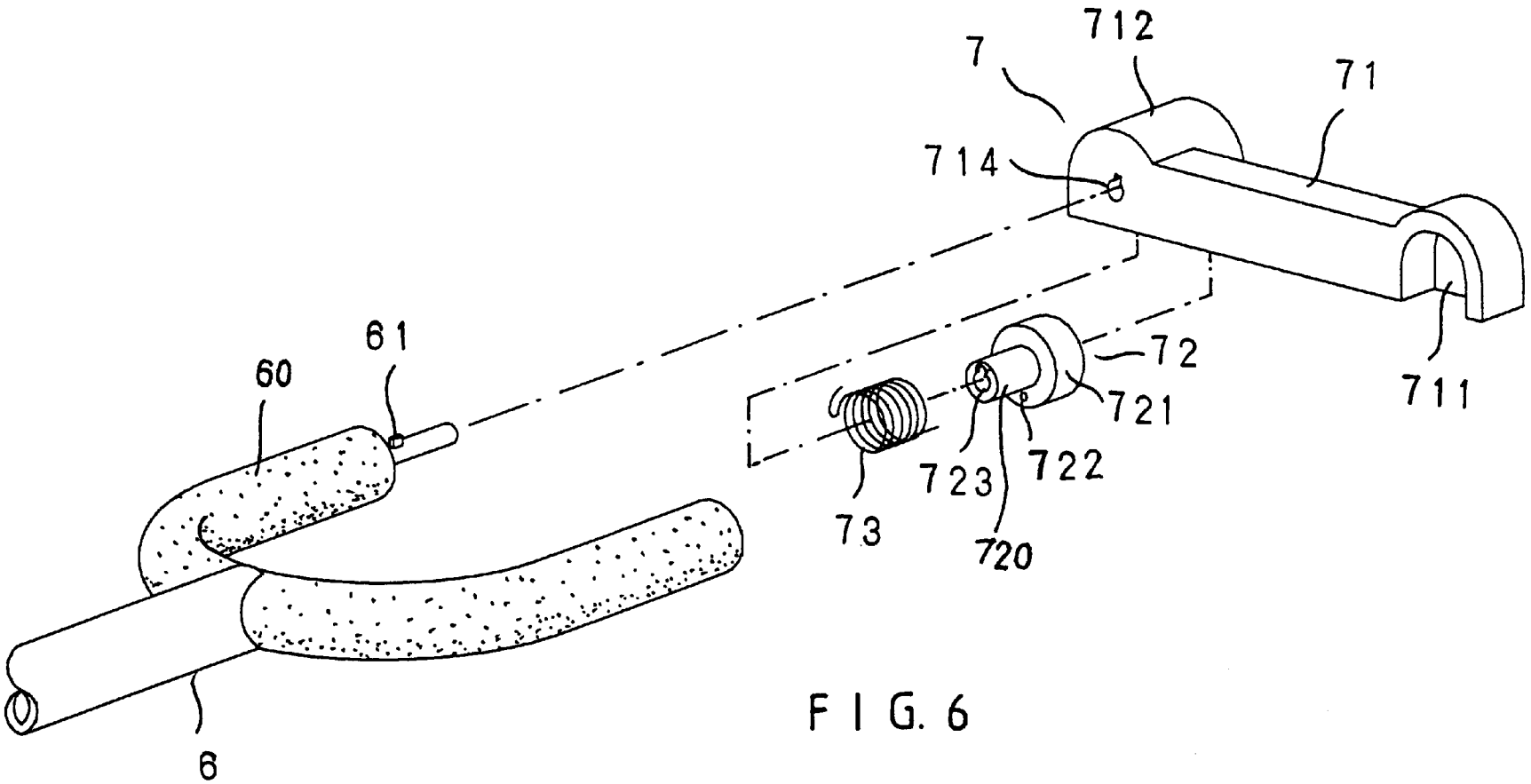
FIG. 6 is a perspective exploded view of an upper holder.
Figure 7:
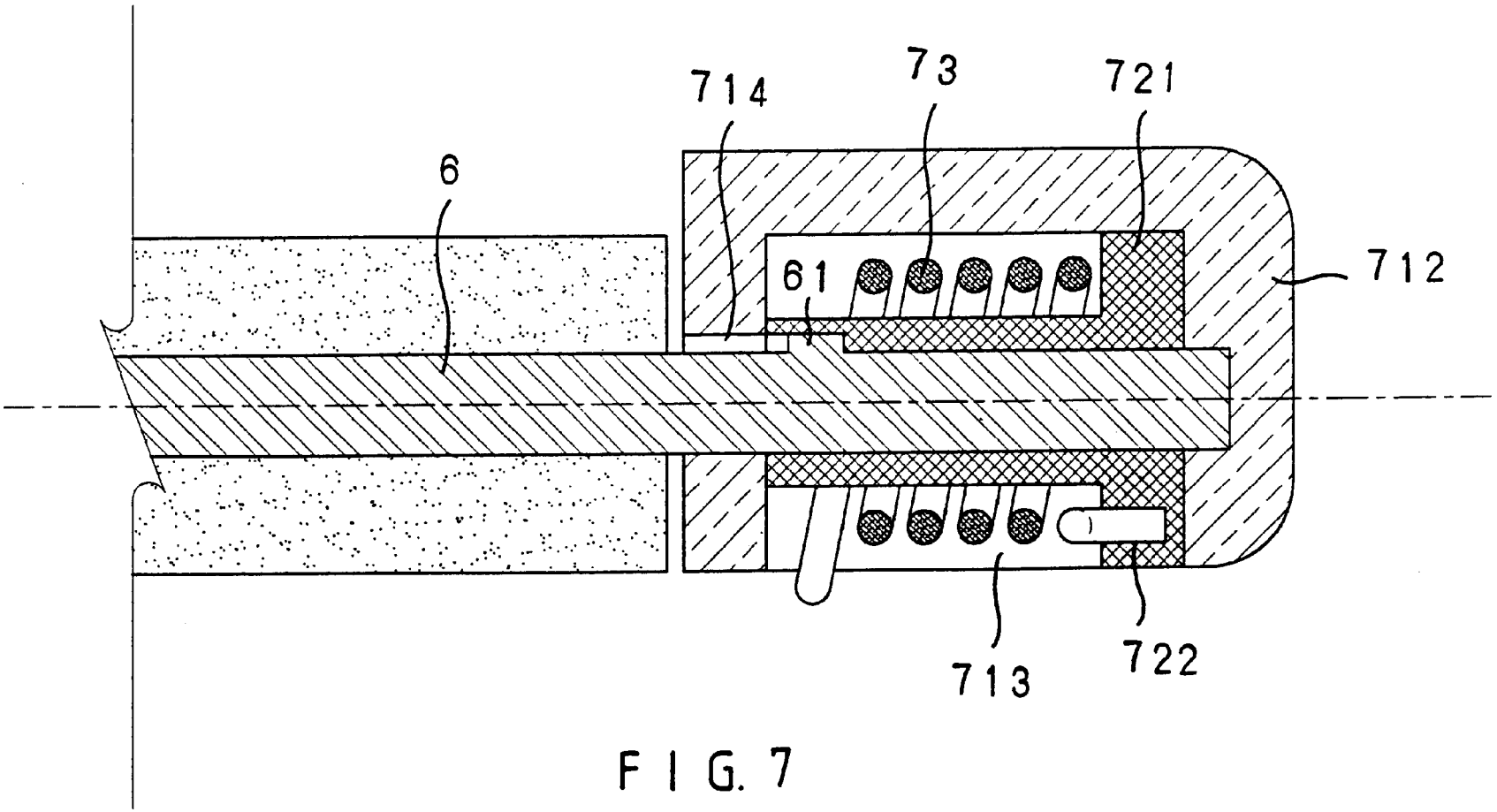
FIG. 7 is a sectional view illustrating a U-shaped rod coupled with a retainer plate.
Figure 8:
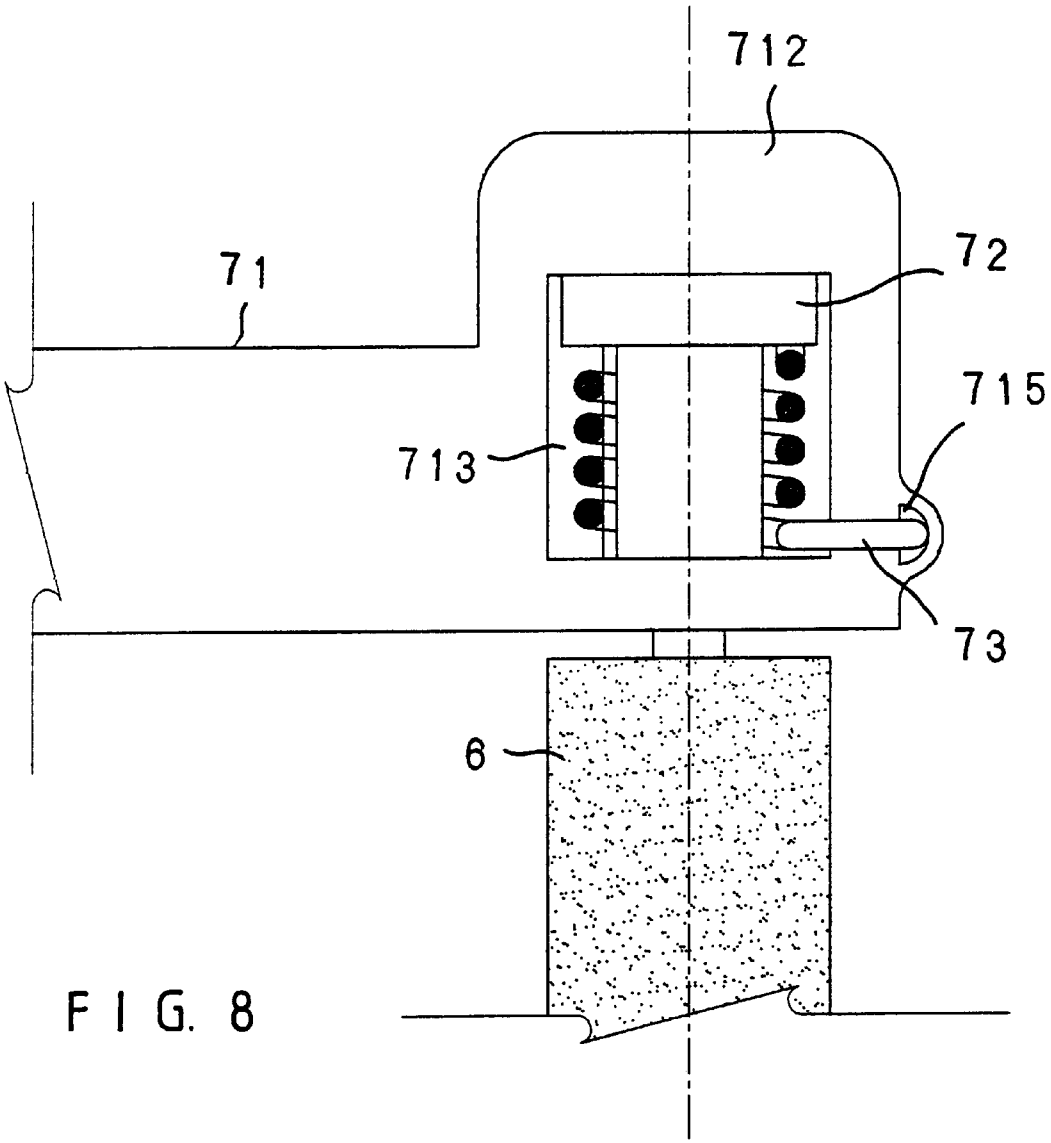
FIG. 8 is another sectional view illustrating a U-shaped rod coupled with a retainer plate.
Figure 9:
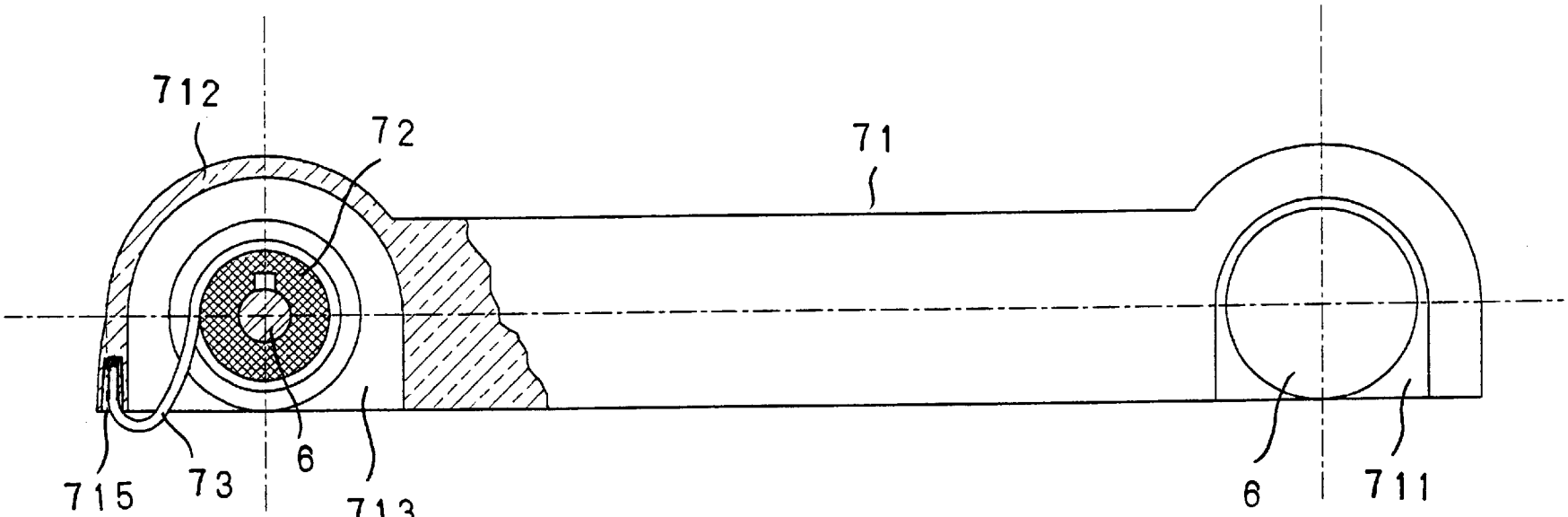
FIG. 9 is a partially sectional view illustrating a U-shaped rod coupled with a retainer plate.
Figure 10:
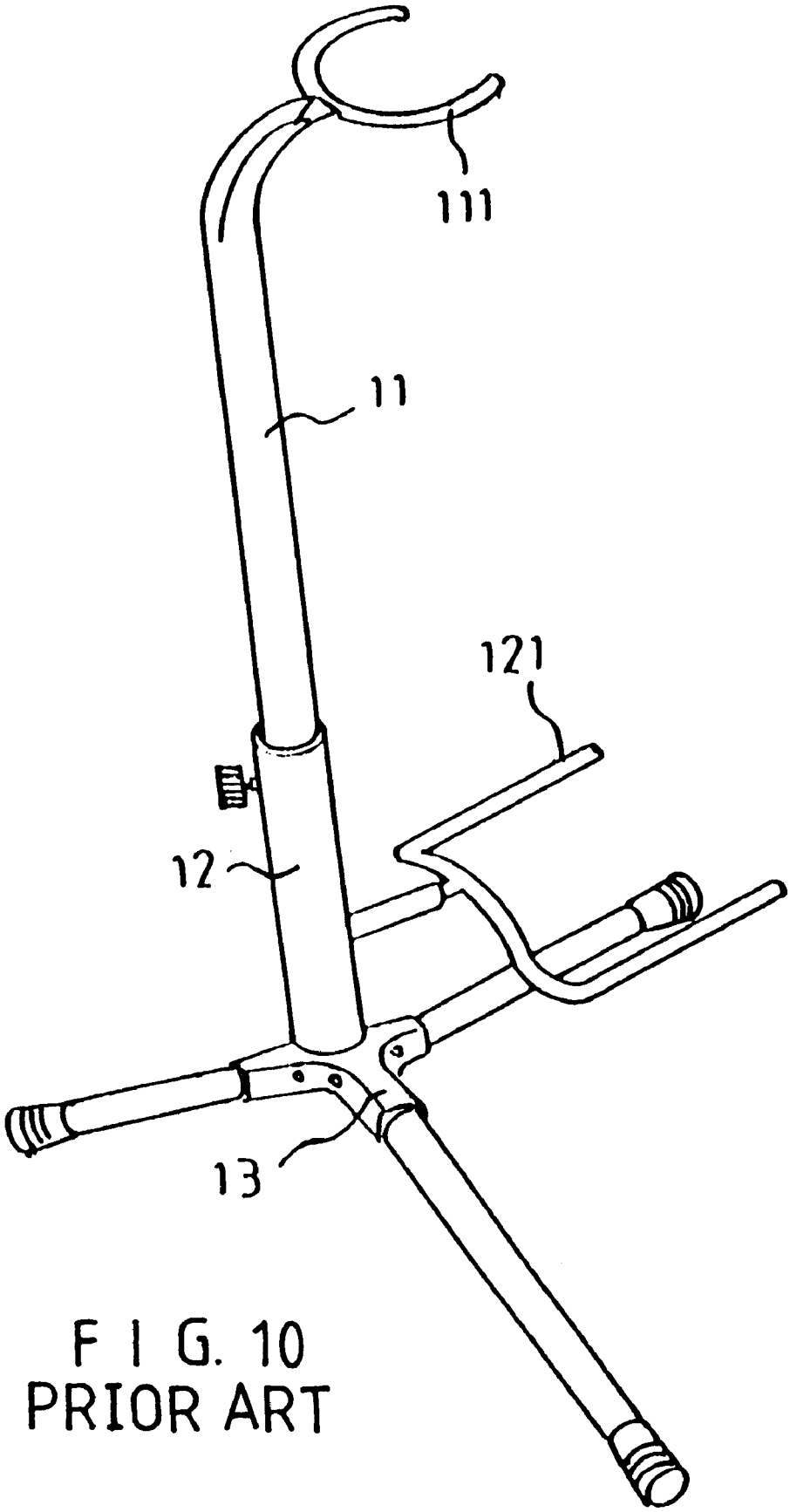
F I G. 10 PRIOR ART
FIG. 10 is a perspective assembly view of a musical instrument stand of the prior art.

Referring to FIG. 5, a positioning bolt 53 fastens the upper holder 6 and the hollow tube 52 together.

Referring to FIGS. 6 to 9, a U-shaped rod 60 is disposed on the upper holder 6. A protruded block 61 is disposed on a first end of the U-shaped rod 60. A retainer plate 7 has a main body 71, a lug end 712 coupled with the first end of the U-shaped rod 60 and a recess end 711 receiving the second end of the U-shaped rod 60. A groove 713 is formed in the lug end 712. A coiled spring 73 and a retainer bolt 72 are inserted in the groove 713. The lug end 712 further comprises a through hole 714. The retainer bolt 72 has a disk 721, a post 720 disposed on the disk 721 to receive the coiled spring 73, an aperture 722 formed on the disk 721 to receive a first end of the coiled spring 73, and a recess hole 723 formed in the post 720 to receive the first end of the U-shaped rod 60. A blind hole 715 is formed in the lug end 712 to receive a second end of the coiled spring 73. Therefore, the first end of the U-shaped rod 60 is inserted in the through hole 714 and the recess hole 723.

The invention is not limited to the above embodiment but various modification thereof may be made. Further, various changes in form and detail may be made without departing from the scope of the invention.

I claim:

1. A musical instrument stand comprising:

an elbow rod device having a joint, a first hollow leg and a second hollow leg, a center through hole formed on a top of the joint, an upper rod inserted in the center through hole, a hollow tube orthogonally disposed on the upper rod, an upper holder inserted through the hollow tube, wherein the upper holder has a main body pivotally and biasingly secured thereto, an adjustment bolt disposed on the joint to adjust a length of the upper rod relative to said joint, the first hollow leg and the second hollow leg securedly disposed beneath said joint, respectively, a first undulated bracket having a first extending end rod, a first middle portion and a first distal end portion, the first extending end rod inserted in a round hole of the first hollow leg transversely, a second undulated bracket having a second extending end rod, a second middle portion and a second distal end portion, the second extending end rod inserted in a circular hole of the second hollow leg transversely, a first base rod having a first strut which is substantially orthogonal thereto and is inserted in a lower portion of the first hollow leg, and a second base rod having a second strut which is inserted in a lower portion of the second hollow leg.

2. The musical instrument stand as claimed in claim 1, wherein a positioning bolt fastens the upper holder and the hollow tube together.

3. The musical instrument stand as claimed in claim 1, wherein a U-shaped rod is disposed on the upper holder.

4. The musical instrument stand as claimed in claim 3, wherein a protruded block is disposed on a first end of the U-shaped rod.

5. The musical instrument stand as claimed in claim 3, wherein a retainer plate has a lug end coupled with the first end of the U-shaped rod and a recess end receiving the second end of the U-shaped rod.

6. The musical instrument stand as claimed in claim 5, wherein a groove is formed in the lug end.

7. The musical instrument stand as claimed in claim 6, wherein a coiled spring and a retainer bolt are inserted in the groove.

8. The musical instrument stand as claimed in claim 7, wherein the lug end further comprises a through hole.

9. The musical instrument stand as claimed in claim 8, wherein the first end of the U-shaped rod is inserted in the through hole and the retainer bolt.

10. The musical instrument stand as claimed in claim 9, wherein the retainer bolt has a disk, a post disposed on the disk to receive the coiled spring, an aperture formed on the disk to receive a first end of the coiled spring, and a recess hole formed in the post to receive the first end of the U-shaped rod.

11. The musical instrument stand as claimed in claim 10, wherein a blind hole is formed in the lug end to receive a second end of the coiled spring.

* * * * *